US006485122B2

(12) United States Patent
Wolf et al.

(10) Patent No.: US 6,485,122 B2
(45) Date of Patent: Nov. 26, 2002

(54) HEAT-INSULATING WALL

(75) Inventors: Ulrich Wolf, Giengen (DE); Wolfgang Kentner, Röfingen (DE); Jürgen Hirath, Bayreuth (DE); Stefan Holzer, Giengen (DE); Adolf Feinauer, Giengen (DE); Richard Horn, Herbrechtingen (DE)

(73) Assignee: BSH Bosch Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 09/933,046

(22) Filed: Aug. 20, 2001

(65) Prior Publication Data

US 2002/0041134 A1 Apr. 11, 2002

Related U.S. Application Data

(63) Continuation of application No. PCT/EP00/01079, filed on Feb. 10, 2000.

(30) Foreign Application Priority Data

Feb. 19, 1999 (DE) ..... 199 07 182

(51) Int. Cl.[7] ..... A47B 96/04

(52) U.S. Cl. ..... 312/406.2; 312/400; 220/592.06; 52/792.1

(58) Field of Search ..... 312/400, 401, 312/406, 406.2, 296; 220/592.1, 592.01, 592.02, 592.06, 592.07, 592.09; 52/312, 800.1, 800.12, 800.15, 792.1

(56) References Cited

U.S. PATENT DOCUMENTS

| | | | | |
|---|---|---|---|---|
| 2,518,673 A | | 8/1950 | Ellsworth | 220/592.06 |
| 2,644,605 A | * | 7/1953 | Palmer | 220/592.06 |
| 2,809,764 A | * | 10/1957 | Diamond | 220/592.06 |
| 2,855,636 A | * | 10/1958 | Donnelly | 52/792.1 |
| 3,353,321 A | | 11/1967 | Heilweil et al. | 52/717.02 |
| 3,380,615 A | | 4/1968 | Kessler | 312/406.2 |
| 4,330,310 A | | 5/1982 | Tate, Jr. et al. | 312/407 X |
| 4,732,432 A | * | 3/1988 | Keil et al. | 312/406.2 |
| 6,038,830 A | * | 3/2000 | Hirath et al. | 52/792.1 |

FOREIGN PATENT DOCUMENTS

| | | | | |
|---|---|---|---|---|
| DE | 1105893 | * | 5/1961 | 312/406.2 |
| EP | 0 161 730 A2 | | 11/1985 | |
| EP | 0 658 716 A1 | | 6/1995 | |
| GB | 1 494 211 | | 12/1977 | |

* cited by examiner

*Primary Examiner*—James O. Hansen
(74) *Attorney, Agent, or Firm*—Laurence A. Greenberg; Werner H. Stemer; Ralph E. Locher

(57) ABSTRACT

A heat-insulating wall, such as a refrigerator door or housing, includes a substantially vacuum-tight outer paneling, an inner paneling, a substantially vacuum-tight connecting diaphragm formed from material having low heat conduction, a diaphragm cover formed from material having low heat conduction, and a protective profile with an opposite magnetic pole or a magnetic seal. The diaphragm is respectively vacuum-tightly connected to the inner paneling and to the outer paneling at free borders thereof. The outer paneling, the diaphragm, and the inner paneling define an evacuable cavity that is filled with an evacuable supporting material. The diaphragm cover covers at least a part of the diaphragm. The protective profile is secured one or both of the inner paneling and the outer paneling and substantially covers the diaphragm cover.

29 Claims, 3 Drawing Sheets

HEAT-INSULATING WALL

CROSS-REFERENCE TO RELATED APPLICATION

This application is a continuation of copending International Application No. PCT/EP00/01079, filed Feb. 10, 2000, which designated the United States.

BACKGROUND OF THE INVENTION

FIELD OF THE INVENTION

The invention relates to a heat-insulating wall, such as a refrigerator door, a refrigerator housing, or the like, having an at least as far as possible vacuum-tight outer paneling that, together with a vacuum-tight connecting diaphragm secured at its free borders and formed from a material with a low level of heat conduction and an inner paneling vacuum-tightly connected to the connecting diaphragm at its free borders, encloses an evacuable cavity filled with an evacuable supporting material. The connecting diaphragm is covered by a diaphragm covering formed from material with a low level of heat conduction.

European Patent EP 06 58 716 B1 describes and illustrates a vacuum-insulation-based heat insulating wall for forming a refrigerator door or a refrigerator housing. The heat-insulating wall disclosed has the outer wall surfaces that are supported in relation to one another by supporting material and are connected to one another at their free borders by a diaphragm produced from a material with a low level of heat conduction, for example, a diaphragm produced from a thin high-grade steel plate. To protect the diaphragm, the diaphragm has a diaphragm covering disposed in front of it, likewise produced from a material with a low level of heat conduction. To not reduce the heat-insulating action of the wall in the region of the diaphragm, use is made of a diaphragm covering made of a heat-insulating material such as foamed plastic. By virtue of its damping action, the diaphragm covering does indeed protect the impact-sensitive, thin-walled diaphragm, and, at the same time, prevents heat conduction between the wall surfaces that are at different temperature levels. However, the more or less porous nature of the foamed material, which, on a function-related basis, has little inherent stability, means that the material is barely suitable, if at all, for anchoring functional parts such as an opposite magnetic pole or the like. Furthermore, with unfavorable force conditions, the material, which is only impact-resistant to a small extent, may be damaged at least on the surface even if subjected to just a low level of force. Such damage has a serious effect not just on the functional capacities of the foamed material, which takes in water more easily as a result, but also on the appearance of the covering. Furthermore, surface treatment of the covering, for example an enameling, as is inevitably required on account of the site of application of the covering because it is directly on view to an end user, can only be carried out with extremely poor results and is in no way permanent.

SUMMARY OF THE INVENTION

It is accordingly an object of the invention to provide a heat-insulating wall that overcomes the hereinafore-mentioned disadvantages of the heretofore-known devices of this general type and that avoids the disadvantages of the prior art by straightforward construction measures.

With the foregoing and other objects in view, there is provided, in accordance with the invention, a heat-insulating wall, including a substantially vacuum-tight outer paneling having free borders, an inner paneling having free borders, a substantially vacuum-tight connecting diaphragm, a diaphragm cover, and a protective profile having a magnet or a magnetic seal. The diaphragm is respectively vacuum-tightly connected to the inner paneling and to the outer paneling at the free borders. The outer paneling, the diaphragm, and the inner paneling define an evacuable cavity. An evacuable supporting material fills the cavity. The diaphragm cover covers at least a part of the diaphragm. The protective profile is secured one or both of the inner paneling and the outer paneling and substantially covers the diaphragm cover. Preferably, the diaphragm and the diaphragm cover are formed from material having a low level of heat conduction.

The diaphragm covering of the invention has a protective profile disposed in front of it. The profile at least as far as possible covering over the diaphragm covering is secured on the inner paneling and/or the outer paneling and is provided with an opposite magnetic pole or magnetic seal.

By virtue of using a protective profile to protect the diaphragm covering, the diaphragm covering can be optimized in a particularly specific manner for the tasks for which it is actually suitable. These tasks include protecting the diaphragm and improving the heat insulation in the border region of the heat-insulating wall. The covering is optimized because the functions over and above the latter, namely securing an opposite pole or a magnetic seal or also producing an esthetically pleasing appearance are assigned to a further component, which is optimized specifically, in terms of the material used and the shaping, for such purposes. Thus, for example, the diaphragm covering may be produced from a material having a sufficient resistance to water diffusion. Furthermore, the diaphragm covering is additionally protected by the at least as far as possible inherently rigid protective profile, in particular, from unintended force peaks as a result of impact loading. It is also possible for the protective profile to be configured cost-effectively, in particular, if it is produced by plastic injection molding, in ways that, on a function-related basis, could not be transferred to the diaphragm covering. Furthermore, dividing up the functions between the protective profile and the diaphragm covering also gives the advantage that the covering may also be configured with relatively thin walls because any pressure loading emanating, for example, from impacts or the like, that may occur is intercepted by the inherently rigid protective profile. In addition, dividing up the functions between the diaphragm covering and the protective profile renders a large selection of materials available for the profile. It is also the case that the protective profile, because it has to perform merely purely mechanical functions, may be configured straightforwardly such that it is easily possible to overcome production tolerances of the heat-insulating wall in the wall region of the heat-insulating wall. As a result, the capacity for producing the heat-insulating wall, and, thus, the possibility of mass-producing the latter, is improved to a considerable extent. Using two components that meet different requirements makes it easily possible to avoid a compromise, which is unavoidable if a single component is used, to the detriment of fulfilling all the required functions.

In accordance with another feature of the invention, the magnet is an opposite magnetic pole.

In accordance with a further feature of the invention, the protective profile is constructed essentially in the manner of a U-profile with a retaining device or retaining means that is provided on the legs and is intended for releasably securing the profile on the inner paneling and/or the outer paneling.

The very U-shaped configuration of the protective profile provides the profile with a certain level of inherent rigidity and dimensional stability. Furthermore, due to the retaining device provided on its legs, the protective profile can be installed particularly straightforwardly and quickly on the free borders of the outer paneling and/or of the inner paneling.

In accordance with an added feature of the invention, the retaining device for securing the U-profile is configured as retaining grooves that can be connected to the free borders of the outer paneling and inner paneling. Such a retaining measure makes it possible for the protective profile to be easily secured with a force fit on the free borders of the outer paneling and the inner paneling. Moreover, the groove-like configuration of the retaining device results in securely positioned fastening on the free borders of the outer paneling and of the inner paneling when the free borders are introduced into the retaining grooves, which serve as a mount for them. As a result, the protective profile is guided laterally in a positionally stable manner.

The opposite magnetic pole or the magnetic seal can be fitted particularly straightforwardly on the U-profile if, in accordance with an additional feature of the invention, the U-profile is provided with the opposite magnetic pole or the magnetic seal on its base, which connects the legs.

It is also the case that such a configuration of the opposite magnetic pole or of the magnetic seal on a refrigerator housing renders the interaction with a magnetic seal provided on a refrigerator door particularly reliable.

In accordance with yet another feature of the invention, the opposite magnetic pole is disposed on the leg side of the base of the U-profile. Such a configuration not only protects the opposite pole against accidental damage, but, at the same time, also makes it possible for the opposite magnetic pole to be used without surface treatment.

In accordance with yet a further feature of the invention, the U-profile has a fastener or fastening means for securing the magnetic seal on its base. The fastener allows not only in particularly quick and specific installation of the magnetic seal, due to the ability to see the installation site, but also in particularly stable fastening for the seal on the protective profile.

In accordance with yet an added feature of the invention, the protective profile, which is formed in the manner of a U-profile, is formed from two angle profiles, of which each can be secured in a releasable manner on the inner paneling and/or outer paneling.

The two-part construction of the protective profile, as a result of the U-profile being divided in two in its longitudinal direction, allows for compensation of either production-induced or temperature-induced tolerances that arise during production of the heat-insulating wall in a particularly straightforward manner. Thus, by virtue of the protective profile being divided in two, allowances can easily be made for production-induced variations in spacing between the outer paneling and the inner paneling in the direction transverse to the temperature gradient.

In accordance with yet an additional feature of the invention, with their legs, which form the base of the U-profile, the angle profiles form a gap in which a latch or latching means provided on the magnetic seal can be fastened in a releasable manner. Thus, along with the straightforward configuration of the angle profiles, the magnetic seal can be installed in a robust and force-saving manner.

A magnetic seal can be disposed and fixed in a precise position in relation to the protective profile, made of two angle profiles, if, in accordance with again another feature of the invention, it is provided that, at its end directed toward the gap, each of the angle legs has a step-like recess running in the gap direction and, together with the adjacent recess, located opposite, of the other profile section, forms a mount for fixing the magnetic seal in the longitudinal direction of the U-profile.

Moreover, such fixing of the magnetic seal on the protective profile, which is cross-sectionally configured in a U-profile, means that the differences in gap width produced as a result of variations in spacing between the inner paneling and the outer paneling are always reliably covered over to the full extent. As a result, it is even possible to use cost-effective production, involving relatively large spacing tolerance positions between the inner paneling and the outer paneling, without the quality of the heat-insulating wall suffering.

The protective profile, which is in a U-profile in cross-section, can be produced particularly straightforwardly and installed particularly straightforwardly on the free borders of the inner paneling and of the outer paneling if, in accordance with again a further feature of the invention, it is provided that the U-profile is subdivided into individual longitudinal sections that can be joined together in a plug connection.

By virtue of the individual protective-profile sections being joined together in a plug-like manner, the profile sections, despite their multi-part construction, impart sufficient dimensional stability.

The longitudinal sections are of a particularly advantageous and expedient configuration if, in accordance with a concomitant feature of the invention, it is provided that the longitudinal sections of the U-profile continue integrally beyond the corner regions of a refrigerator door or of a refrigerator housing.

Other features that are considered as characteristic for the invention are set forth in the appended claims.

Although the invention is illustrated and described herein as embodied in a heat-insulating wall, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
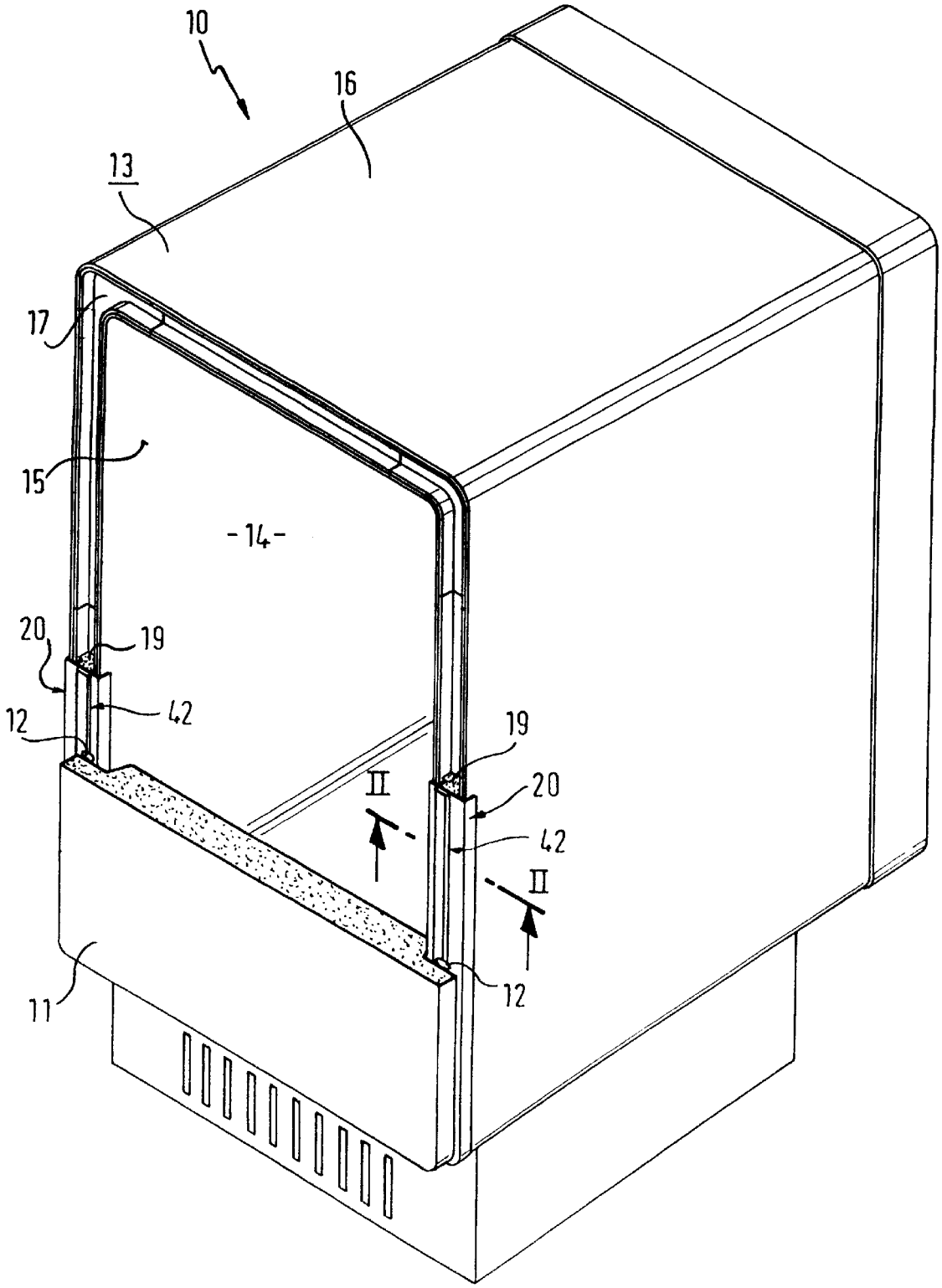
FIG. 1 is a partly broken away perspective view from the front of a vacuum-insulated refrigerator housing with free borders of paneling securing a protective profile for covering a diaphragm covering according to the invention.

In all the figures of the drawing, sub-features and integral parts that correspond to one another bear the same reference symbol in each case.

Figure 2:
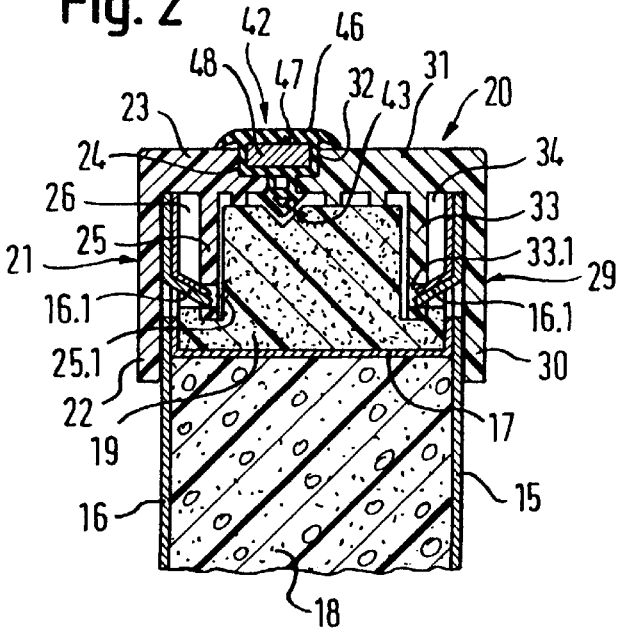
FIG. 2 is a fragmentary, cross-sectional view of a first embodiment of a protective profile of the vacuum-insulated refrigerator housing of FIG. 1 in a vicinity of a door along section line II—II.

Referring now to the figures of the drawings in detail and first, particularly to FIG. 1 thereof, there is shown a simplified schematic illustration of a household refrigerator 10 with a door 11, illustrated in the closed state, that is heat-insulated in a conventional manner by expansion and is provided with a magnetic seal 12 all the way round its free borders. The door 11 is mounted pivotably by non-illustrated hinges on a vacuum-insulated refrigerator housing 13 that accommodates a refrigerator chamber 14 inside. The refrigerating chamber 14 is lined by an as far as possible vacuum-tight inner paneling 15 formed from high-grade steel and has an outer paneling 16 spaced apart from inner paneling 15. The outer paneling 16 is likewise formed from high-grade steel plate and has retaining noses 16.1 provided on its border sections that are directed toward the door 11. Those border sections of the inner paneling 15 and of the outer paneling 16 that are directed toward the door 11 are connected in a vacuum-tight manner to a cross-sectionally U-shaped diaphragm 17 formed from a thin-walled material with a low level of heat conduction. The diaphragm 17 provides, between the outer paneling 16 and the inner paneling 15, an evacuable interspace that is filled with evacuable supporting material 18, for example, open-cell polystyrene foam or the like. The supporting material 18 supports the inner paneling 15 and the outer paneling 16. On the outside, which is directed away from the supporting material 18, the diaphragm 17 is covered by a diaphragm covering 19 formed from tough, permanently elastic polyethylene foam (to protect its thin-walled base) and, with a bulk density of between 70 and 100 kg per $m^3$, has a sufficient resistance to a diffusion of moisture. As a result, the diaphragm 17 is protected against condensation. For its protection, the diaphragm covering 19, which is produced from foamed material, has a protective profile 20 disposed in front of it. The profile 20 is constructed essentially in the manner of a U-profile in cross-section. According to a first exemplary embodiment (see FIGS. 2 and 3), the profile 20 is made up of two sub-profiles that are essentially angled in cross-section and are constructed in a mirror-inverted manner. A first of the sub-profiles, sub-profile 21 has an angle leg 22 and an angle leg 23 disposed perpendicularly thereto. The angle leg 23 is provided, at its free end, with a recess 24 that is set back in a step-like manner. In addition to the step-like recess 24, the angle leg 23 has, on its underside, located opposite the recess 24, a retaining wall 25 that is set back in relation to the free end of the angle leg 22 and has a retaining opening 25.1 that is spaced apart from the angle leg 22, parallel thereto. By virtue of the retaining wall 25 and the angle leg 22 being spaced apart parallel to one another, a retaining groove 26 is formed between them. Both the angle leg 22 and the angle leg 23 have, at their free ends, a respective section 27, 28 that is set back in a step-like manner in relation to the outside of the legs, the retaining wall 25 extending as far as the start of the section 27, 28.

Figure 3:
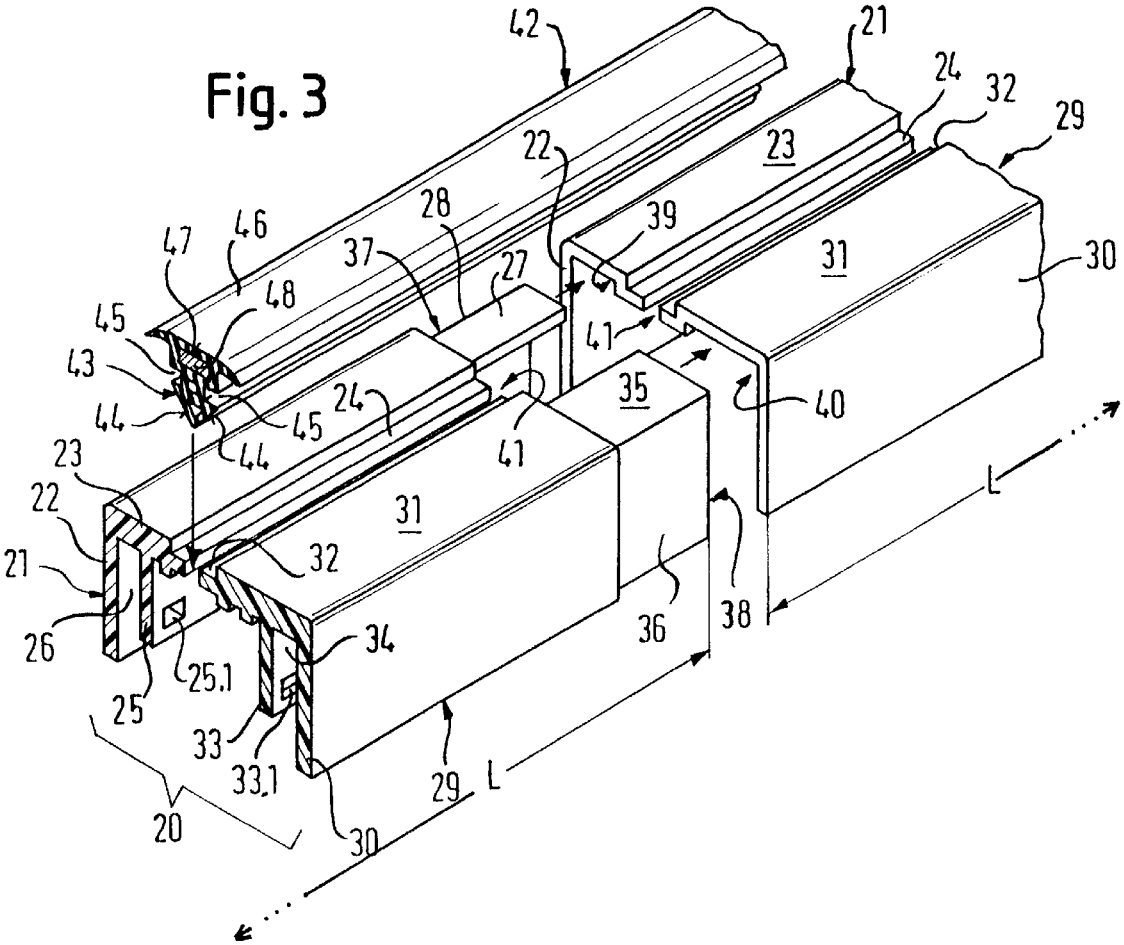
FIG. 3 is a fragmentary, partly exploded, perspective and cross-sectional view from the front of part of the protective profile of FIG. 2.

As can be seen, in particular, from FIG. 3, the cross-sectionally essentially U-shaped protective profile 20 has, in addition to the sub-profile 21, a further sub-profile 29 constructed in a mirror-inverted manner in relation to the sub-profile 21. Like sub-profile 21, further sub-profile 29 has a first angle leg 30 and a second angle leg 31 that is disposed essentially perpendicularly thereto and, like the angle leg 23, is provided at its free end with a recess 32 that is set back in a step-like manner. In addition to the recess 32, the angle leg 31 is provided on its underside, located opposite the recess 32, with a retaining wall 33 with a retaining opening 33.1. The retaining wall 33, which has its free end set back in relation to the free end of the angle leg 30, is spaced apart from the angle leg 30, parallel thereto. As a result, a retaining groove 34 is formed between the angle leg 30 and the retaining wall 33. Like the angle legs 22 and 23, the angle legs 30 and 31 have, at their free ends, a respective section 35, 36 that is set back in a step-like manner in relation to the outside of the legs. The retaining wall 33, and, thus, the retaining groove 34, extend as far as the start of the sections 35, 36. Plug-connection elements 37, 38 are respectively formed on the sub-profile 29, 21 by the sections 35, 36 and 27, 28, respectively. Opposite the plug-connection elements 37, 38, each of the sub-profiles 21 and 29, which are subdivided into longitudinal sections of length L, is provided with a respective plug-connection mount 39, 40. The plug-connection elements 37 and 38 are to be introduced into the mounts 39, 40 (as indicated by the arrows). As a result, the individual longitudinal sections of the sub-profiles 21 and 22 can be joined together to form a continuous profile. The sub-profiles 21, 29 that are made up of individual length sections 1 to n, are fixed, by their respective retaining groove 26, 34, on the free end sections of the inner paneling 15 and of the outer paneling 16, and are fastened thereon by a form-fitting connection between the retaining noses 16.1 and the retaining openings 25.1 and 33.1. In the installed state, the sub-profiles 21, 29 form the U-profile-like protective profile 20. With the sub-profiles 21, 29 in the joined state, a gap 41 is formed between the free ends of their angle legs 23 and 31. The gap 41 has, disposed in front of the gap 41, a mount formed by the recess 24 and the recess 32 in the installed state of the sub-profiles 21, 29. The gap 41 serves to fasten a magnetic seal 42 that, for such a purpose, is provided with a sealing foot 43 having a leading introduction slope 44 and undercuts 45 adjoining the same. The sealing foot 43 is connected elastically to a sealing head 46, which is configured as a hollow profile and has a hollow chamber 47 that runs in the longitudinal direction of the magnetic seal 42 and into which is inserted a permanent bar-like magnet 48. With the protective profile 20 installed at the free ends of the inner paneling 15 and of the outer paneling 16, the permanent magnet 48, as can be seen from FIG. 2, in particular, interacts, in the closed state of the door 12, with a permanent magnet of the magnetic seal 12. As a result, the door 11 rests in a sealed manner on the opening border of the refrigerator housing 13, the border being formed by the protective profile 20.

Figure 4:
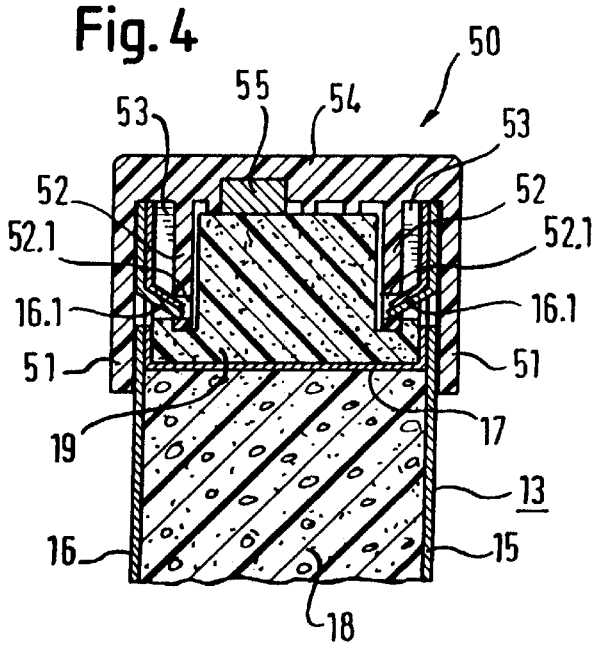
FIG. 4 is a fragmentary, cross-sectional view from above of a second embodiment of a protective profile of the vacuum-insulated refrigerator housing of FIG. 1 in a vicinity of a door.
Figure 5:
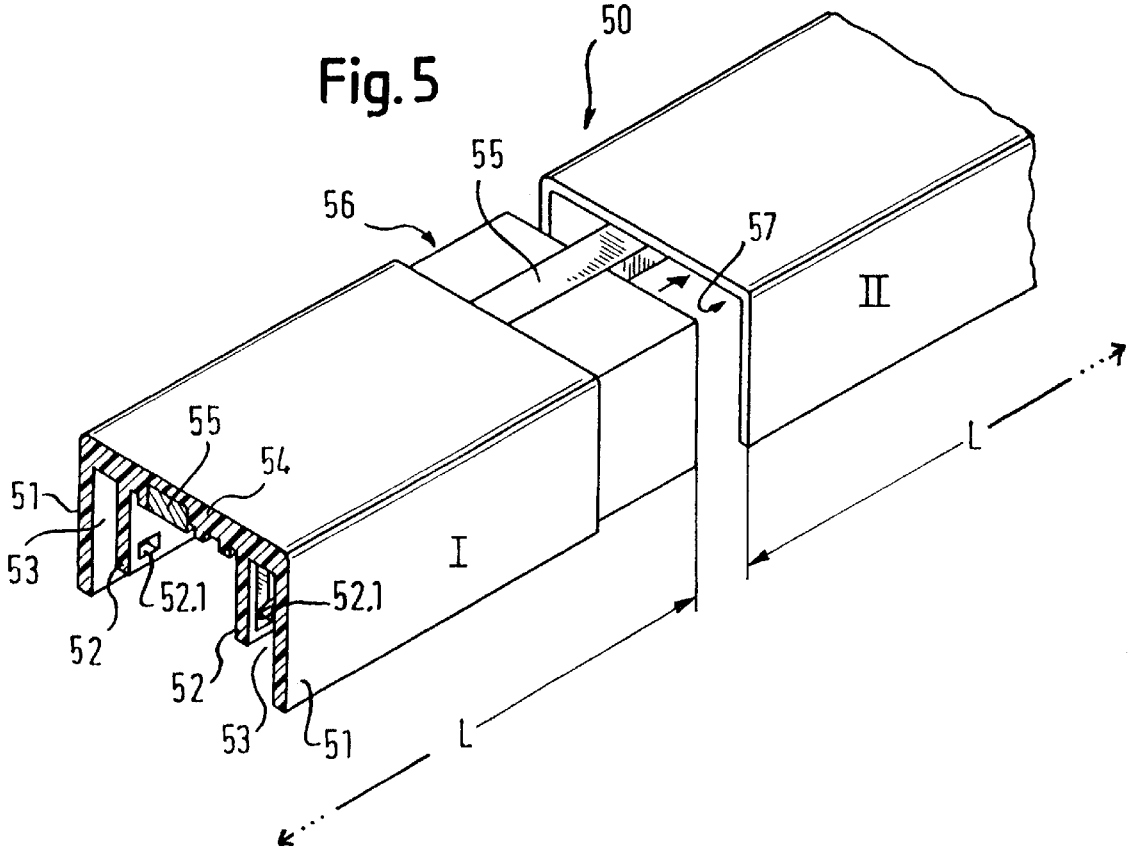
FIG. 5 is a fragmentary, partly exploded perspective and cross-sectional view from the front of part of the protective profile of FIG. 4.

FIG. 4 illustrates a second variant of a protective profile 50, which, like the protective profile 20, has an essentially U-shaped configuration in cross-section. However, in contrast to the protective profile 20, is not subdivided into sub-profiles. The protective profile 50 has retaining walls 52 that are spaced apart from its U-profile legs 51, parallel thereto, and have retaining openings 52.1, the free end of the retaining wall 52 being set back in relation to the free end of the U-profile legs. By virtue of the retaining wall 52 and the U-profile leg 51 being spaced apart parallel to one another, a retaining groove 53 is formed respectively between the legs 51 and the retaining walls 52. Between the retaining walls 52, the protective profile 50, produced, for example, from a plastic injection molding, is provided, on its base 54, with an insert part that, in the present case, is configured as a bar-like permanent magnet 55 that, for its protection, is covered over by the outside of the base 54, located opposite the free ends of the retaining walls 52.

The protective profile 50, like the protective profile 20, is subdivided into individual longitudinal sections 1 to n of length L. The longitudinal sections extending beyond the corner regions of the refrigerator housing 13 are configured as integral continuations, and two adjacent longitudinal sections, i.e., sections I and II, can be connected to one another by a type of plug connection. For such a purpose, the longitudinal section I is provided, at one of its free ends, with a shoulder that juts back in a step-like manner in relation to the outside of the longitudinal section and serves as a plug-connection element 56. Longitudinal section II has, at its end section directed toward longitudinal section I, a plug-connection mount 57 that is disposed within the U-profile space and into which the plug-connection element 56 can be introduced in the direction of the arrow.

To facilitate installation, the longitudinal sections 1 to n of the protective profile 50 can be fixed individually, by way of their retaining grooves 53, on the free borders of the inner paneling 15 and/or the outer paneling 16 and can be latched, by way of their retaining openings 52.1 to the retaining noses 16.1. As a result, the longitudinal sections, which have been joined together to form the protective profile 50 through the plug-connection mounts 57 accommodating the plug-connection elements 56, are retained on the free end sections of the inner paneling 15 and of the outer paneling 16. In the installed state of the protective profile 50 or 20, which is disposed all the way around and is produced from plastic such as polyethylene, polystyrene, or similar plastic, the sharp-edged free borders of the inner paneling 15 and of the outer paneling 16 and, at the same time, the impact-sensitive diaphragm covering 19 are covered in a protected manner.

We claim:

1. A heat-insulating wall, comprising:

a substantially vacuum-tight outer paneling having free borders;

an inner paneling having free borders;

a substantially vacuum-tight connecting diaphragm;

said diaphragm respectively vacuum-tightly connected to said inner paneling and to said outer paneling at said free borders;

said outer paneling, said diaphragm, and said inner paneling defining an evacuable cavity;

an evacuable supporting material filling said evacuable cavity;

a diaphragm cover covering at least a part of said diaphragm;

a protective profile having one of a magnet and a magnetic seal; and said protective profile:

secured on at least one of said inner paneling and said outer paneling; and substantially covering said diaphragm cover.

2. The wall according to claim 1, wherein said magnet is an opposite magnetic pole.

3. The wall according to claim 1, wherein said protective profile:

is substantially U-shaped; and has two legs with a retainer for releasably securing said protective profile on at least one of said inner paneling and said outer paneling.

4. The wall according to claim 3, wherein said retainer is a retaining groove connected to said free borders of said inner paneling and said free borders of said outer paneling.

5. The wall according to claim 3, wherein:

said protective profile has a base connecting said two legs; and said one of said magnet and said magnetic seal is disposed on said base.

6. The wall according to claim 5, wherein:

said base has a side facing said two legs; and said magnet is disposed on said side.

7. The wall according to claim 5, wherein said protective profile has means for securing said magnetic seal on said base.

8. The wall according to claim 5, wherein said protective profile has a fastener securing said magnetic seal on said base.

9. The wall according to claim 3, wherein:

said protective profile is formed from two angle profiles; and each of said two angle profiles is secured on a respective one of said inner paneling and said outer paneling.

10. The wall according to claim 9, wherein:

each of said two angle profiles has a base and one of said two legs;

said two angle profiles form a gap with a respective pair of said base and said one leg;

said gap is a fastener; and said magnetic seal has a releasable latch for releasably latching said magnetic seal in said gap.

11. The wall according to claim 10, wherein:

said protective profile has a longitudinal direction;

each of said two legs has an end directed toward said gap and a step-like recess disposed at said end; and said recesses of said two legs together form a mount for fixing said magnetic seal in said mount in said longitudinal direction.

12. The wall according to claim 9, wherein:

each of said two angle profiles has a base and one of said two legs;

said two angle profiles form a gap from said base and said two legs;

said gap is a fastener; and said magnetic seal has a means for releasably latching said magnetic seal in said gap.

13. The wall according to claim 3, wherein said protective profile is subdivided into individual longitudinal sections to be joined together with a plug connection.

14. The wall according to claim 13, wherein:

said protective profile has corner regions; and said longitudinal sections integrally continue through said corner regions.

15. The wall according to claim 1, wherein said protective profile:

is substantially U-shaped;

has two legs;

has means for releasably retaining said protective profile on at least one of said inner paneling and said outer paneling; and said retaining means is disposed on said two legs.

16. The wall according to claim 15, wherein said retaining means is a retaining groove connected to said free borders of said inner paneling and said free borders of said outer paneling.

17. The wall according to claim 15, wherein:

said protective profile has a base connecting said two legs; and said one of said magnet and said magnetic seal is disposed on said base.

18. The wall according to claim 17, wherein:

said base has a side facing said two legs; and said magnet is disposed on said side.

19. The wall according to claim 17, wherein said protective profile has means for securing said magnetic seal on said base.

20. The wall according to claim 17, wherein said protective profile has a fastener securing said magnetic seal on said base.

21. The wall according to claim 15, wherein:

said protective profile is formed from two angle profiles; and each of said two angle profiles is secured on a respective one of said inner paneling and said outer paneling.

22. The wall according to claim 21, wherein:

each of said two angle profiles has a base and one of said two legs;

said two angle profiles form a gap with a respective pair of said base and said one leg;

said gap is a fastener; and said magnetic seal has a releasable latch for releasably latching said magnetic seal in said gap.

23. The wall according to claim 22, wherein:

said protective profile has a longitudinal direction;

each of said two legs has an end directed toward said gap and a step-like recess disposed at said end; and said recesses of said two legs together form a mount for fixing said magnetic seal in said mount in said longitudinal direction.

24. The wall according to claim 21, wherein:

each of said two angle profiles has a base and one of said two legs;

said two angle profiles form a gap from said base and said two legs;

said gap is a fastener; and said magnetic seal has a means for releasably latching said magnetic seal in said gap.

25. The wall according to claim 15, wherein said protective profile is subdivided into individual longitudinal sections to be joined together with a plug connection.

26. The wall according to claim 25, wherein:

said protective profile has corner regions; and said longitudinal sections integrally continue through said corner regions.

27. A refrigerator door, comprising:

a substantially vacuum-tight outer paneling having free borders;

an inner paneling having free borders;

a substantially vacuum-tight connecting diaphragm;

said diaphragm respectively vacuum-tightly connected to said inner paneling and to said outer paneling at said free borders;

said outer paneling, said diaphragm, and said inner paneling defining an evacuable cavity;

an evacuable supporting material filling said evacuable cavity;

a diaphragm cover covering at least a part of said diaphragm;

a protective profile having one of a magnet and a magnetic seal; and said protective profile:

secured on at least one of said inner paneling and said outer paneling; and substantially covering said diaphragm cover.

28. A refrigerator housing, comprising:

a substantially vacuum-tight outer paneling having free borders;

an inner paneling having free borders;

a substantially vacuum-tight connecting diaphragm;

said diaphragm respectively vacuum-tightly connected to said inner paneling and to said outer paneling at said free borders;

said outer paneling, said diaphragm, and said inner paneling defining an evacuable cavity;

an evacuable supporting material filling said evacuable cavity;

a diaphragm cover covering at least a part of said diaphragm;

a protective profile having one of a magnet and a magnetic seal; and said protective profile:

secured on at least one of said inner paneling and said outer paneling; and substantially covering said diaphragm cover.

29. A heat-insulating wall, comprising:

a substantially vacuum-tight outer paneling having free borders;

an inner paneling having free borders;

a substantially vacuum-tight connecting diaphragm formed from material having properties including a low level of heat conduction;

said diaphragm respectively vacuum-tightly connected to said inner paneling and to said outer paneling at said free borders;

said outer paneling, said diaphragm, and said inner paneling defining an evacuable cavity;

an evacuable supporting material filling said evacuable cavity;

a diaphragm cover formed from material having properties including a low level of heat conduction;

said diaphragm cover covering at least a part of said diaphragm;

a protective profile having one of a magnet and a magnetic seal; and said protective profile:

secured on at least one of said inner paneling and said outer paneling; and substantially covering said diaphragm cover.

* * * * *